US007890017B2

(12) United States Patent
Naitoh et al.

(10) Patent No.: US 7,890,017 B2
(45) Date of Patent: Feb. 15, 2011

(54) FIXING DEVICE AND IMAGE FORMING APPARATUS

(75) Inventors: Yutaka Naitoh, Hyogo (JP); Yoshikazu Yamazoe, Osaka (JP); Shigeo Nanno, Kyoto (JP); Osamu Saito, Ibaraki (JP); Takuya Etoh, Osaka (JP)

(73) Assignee: Ricoh Company, Limited, Tokyo (JP)

( * ) Notice: Subject to any disclaimer, the term of this patent is extended or adjusted under 35 U.S.C. 154(b) by 332 days.

(21) Appl. No.: 12/199,219

(22) Filed: Aug. 27, 2008

(65) Prior Publication Data

US 2009/0060572 A1 Mar. 5, 2009

(30) Foreign Application Priority Data

Aug. 31, 2007 (JP) ..... 2007-227103

(51) Int. Cl.
*G03G 15/00* (2006.01)
*G03G 15/16* (2006.01)
*G03G 15/20* (2006.01)

(52) U.S. Cl. ..... 399/107; 399/110; 399/122; 399/320; 399/328

(58) Field of Classification Search ..... 399/107, 399/110, 122, 320, 328
See application file for complete search history.

(56) References Cited

U.S. PATENT DOCUMENTS

| | | | | |
|---|---|---|---|---|
| 7,013,099 | B2 * | 3/2006 | Shirakata | 399/92 |
| 2004/0091283 | A1 * | 5/2004 | Nobe et al. | 399/110 |
| 2007/0110475 | A1 * | 5/2007 | Idehara et al. | 399/118 |
| 2007/0201914 | A1 * | 8/2007 | Tsuji et al. | 399/328 |
| 2007/0280752 | A1 * | 12/2007 | Uchida | 399/323 |
| 2008/0056783 | A1 | 3/2008 | Yamamoto et al. | |

FOREIGN PATENT DOCUMENTS

| | | |
|---|---|---|
| JP | 11-149229 | 6/1999 |
| JP | 3808069 | 5/2006 |

* cited by examiner

*Primary Examiner*—David P Porta
*Assistant Examiner*—Mindy Vu
(74) *Attorney, Agent, or Firm*—Oblon, Spivak, McClelland, Maier & Neustadt, L.L.P.

(57) ABSTRACT

A fixing device includes a pair of first frames that support an axis of each of a fixing roller and a pressing roller and a pair of second frames arranged in parallel to an axial direction of the fixing roller to connect the first frames to each other. The second frames include cover portions that cover an upper peripheral surface and a lower peripheral surface of the rollers. A coupling member couples the cover portions to each other and has a bridge structure between the cover portions.

16 Claims, 5 Drawing Sheets

FIXING DEVICE AND IMAGE FORMING APPARATUS

CROSS-REFERENCE TO RELATED APPLICATIONS

The present application claims priority to and incorporates by reference the entire contents of Japanese priority document 2007-227103 filed in Japan on Aug. 31, 2007.

BACKGROUND OF THE INVENTION

1. Field of the Invention

The present invention relates to a technology for adjusting a position of a component in a fixing device of an image forming apparatus.

2. Description of the Related Art

As is well known, in image forming apparatuses such as printers, copiers, facsimile apparatuses, or printing machines, an electrostatic latent image formed on an image carrier is developed with toner into a toner image, and the toner image is transferred and fixed onto a recording medium, so that a copy of an original is obtained.

A fixing device is commonly employed that has a heat-roller fixing system in which a pair of rollers is opposed to each other across a path for conveying a recording medium.

The fixing device includes various sensors to control temperature, safety, exchange timing of the fixing device, or the like. The sensors are arranged so that an appropriate positional relation to a fixing member that is used for fixing is maintained.

The sensors formed as electric components are connected to a control unit or the like through a harness. A harness is susceptible to heat unlike a sensor. Therefore, positional accuracy with the fixing member is seriously controlled with respect to a position at which a harness is wired as well as a position of a sensor, as safety measures for disconnecting or the like.

For example, Japanese Patent Application Laid-open No. H11-149229 discloses a conventional configuration concerning arrangement of a sensor. Specifically, a temperature sensor that detects temperature of a surface of a fixing roller as a fixing member is arranged to a free end of a cantilever plate spring so that the temperature sensor comes into contact with the surface of the fixing roller. The position at which the temperature sensor comes into contact with the surface of the fixing roller is adjusted depending on rotation of the fixing roller or stopping of rotation of the fixing roller while the temperature sensor is controlled to keep coming into contact with the surface of the fixing roller by a plate spring. Furthermore, Japanese Patent No. 3808069 discloses another configuration concerning arrangement of a sensor. In this technology, a predetermined space between a fixing roller and a temperature sensor that are opposed to each other is maintained such that the temperature sensor is attached to an arm that is connected to and supported by a frame through a plate spring, and a direction in which the temperature sensor comes into contact with or released from a peripheral surface of the fixing roller is determined based on a fastening force to a plate spring as well as movement of the arm at a position at which it is connected to the frame.

However, a supporting member that supports the temperature sensor needs to have high accuracy in determining a positional relation with the fixing roller. Therefore, processing accuracy and assembling accuracy are required for the supporting member, leading to an increase of manufacturing costs. Particularly, as Japanese Patent Application Laid-open No. H11-149229 discloses, when a position of the temperature sensor with respect to the fixing roller can be adjusted, a space occupied by the supporting member needs to include an extra space where the temperature sensor is to be adjusted. Therefore, a space for the supporting member in a fixing device is increased. As a result, a size of the fixing device increases, increasing manufacturing costs.

SUMMARY OF THE INVENTION

It is an object of the present invention to at least partially solve the problems in the conventional technology.

According to an aspect of the present invention, there is provided a fixing device that includes a fixing roller that applies heat to a recording medium on a conveyor path; a pressing roller that is opposed to the fixing roller across the conveyor path and extends parallel to an axial direction of the fixing roller; a casing that houses the fixing roller and the pressing roller in a rotatable manner; a pair of first frames that support an axis of each of the fixing roller and the pressing roller; a pair of second frames arranged in parallel to the axial direction such that the first frames are connected to each other via the second frames; a first cover portion that is arranged on one of the second frames and covers an upper peripheral surface of at least one of the fixing roller and the pressing roller; a second cover portion that is arranged on another one of the second frames and covers a lower peripheral surface of at least one of the fixing roller and the pressing roller; and a coupling member that couples the first cover portion to the second cover portion and has a bridge structure from the first cover portion to the second cover portion.

According to another aspect of the present invention, there is provided an image forming apparatus that includes the above fixing device.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are explained in detail below with reference to the accompanying drawings.

Figure 1:
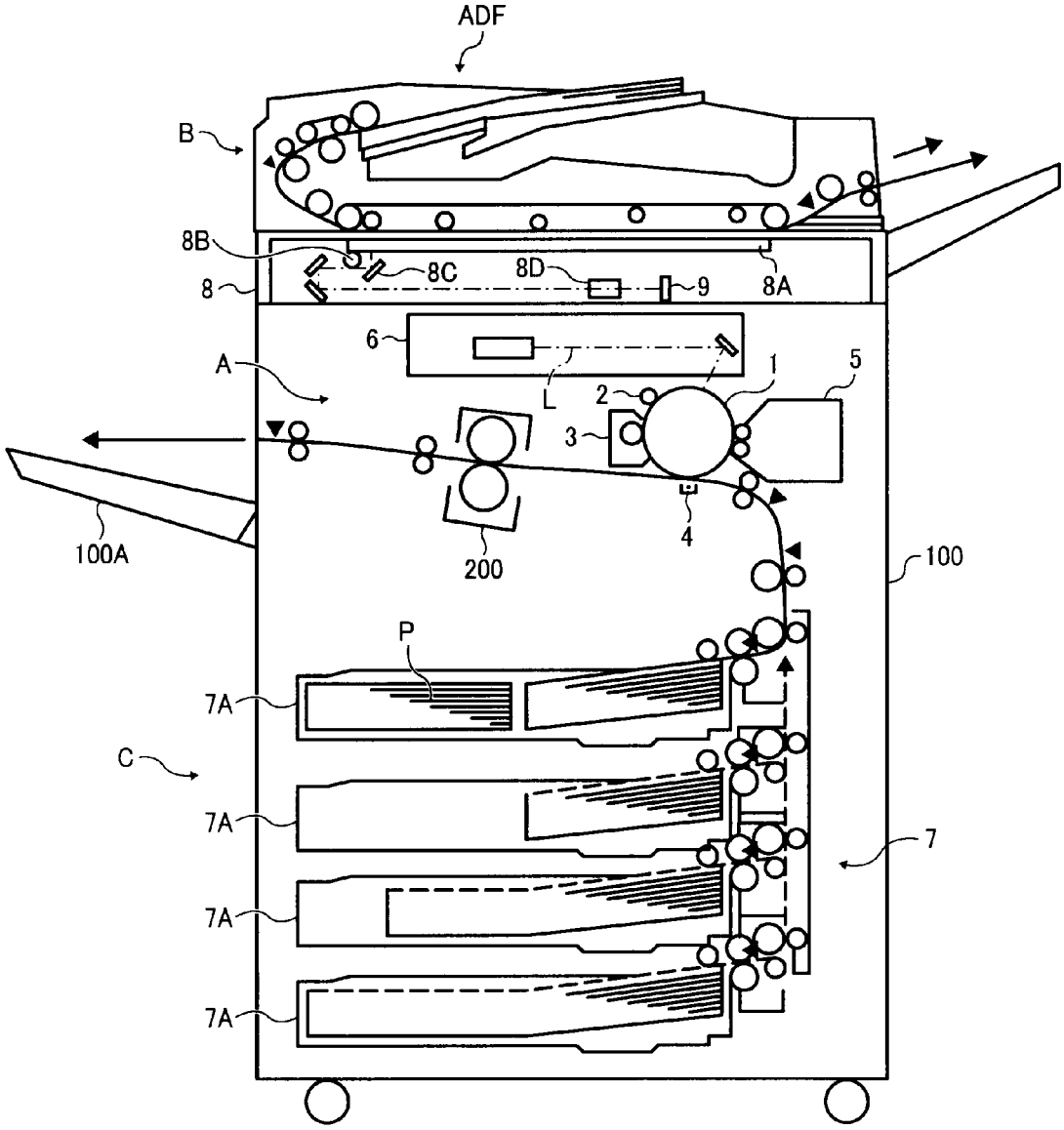
FIG. 1 is a schematic diagram of an image forming apparatus having a fixing device according to an embodiment of the present invention.

FIG. 1 is a schematic diagram of an image forming apparatus 100 that includes a fixing device according to an embodiment of the present invention. The image forming apparatus 100 is a laser printer in which an electrostatic latent image is formed on an image carrier by writing processing with a laser beam. The present invention is not limited to a laser printer and can be applied to other image forming apparatuses such as a copier, a facsimile apparatus, or a printing machine.

The image forming apparatus 100 includes an image forming unit A positioned substantially at the center of the image forming apparatus 100, an original scanning unit B mounted on the image forming unit A, and a paper-feeding unit C arranged below the image forming unit A.

The image forming unit A includes a photosensitive drum 1 that is rotatable as an image carrier. A charging unit 2, a developing unit 3, a transferring unit 4, and a cleaning unit 5 are arranged around the photosensitive drum 1 to form an image during rotation of the photosensitive drum 1. After the photosensitive drum 1 is uniformly charged by the charging unit 2, an electrostatic latent image is formed based on image information or an original with a laser beam L from a writing unit 6. The electrostatic latent image is then developed with toner by the developing unit 3.

A registration timing is set by registration rollers 7 with respect to a recording sheet P as a recording medium that is selected from any one of a plurality of feeding cassettes 7A arranged in the paper-feeding unit C. The recording sheet P is conveyed to a transfer position at which the transferring unit 4 and the photosensitive drum 1 are brought into contact with each other. A toner image carried on the photosensitive drum 1 of the image forming unit A is transferred to the recording sheet P by the transferring unit 4.

After the toner image is transferred, the toner image on the recording sheet P is fixed by a fixing device 200 while the recording sheet P is conveyed to a discharging tray 100A.

The original scanning unit B includes an automatic document feeder (ADF) and an optical scanning unit 8. A light beam from a light source 8B of the optical scanning unit 8 is emitted to an original that is conveyed from the ADF and that is placed on a contact glass 8A while scanning. The light reflected from the original is caused to form an image at a photoelectric conversion element 9 that includes a charge coupled device (CCD) through a plurality of mirrors 8C and an imaging lens 8D.

Figure 2:
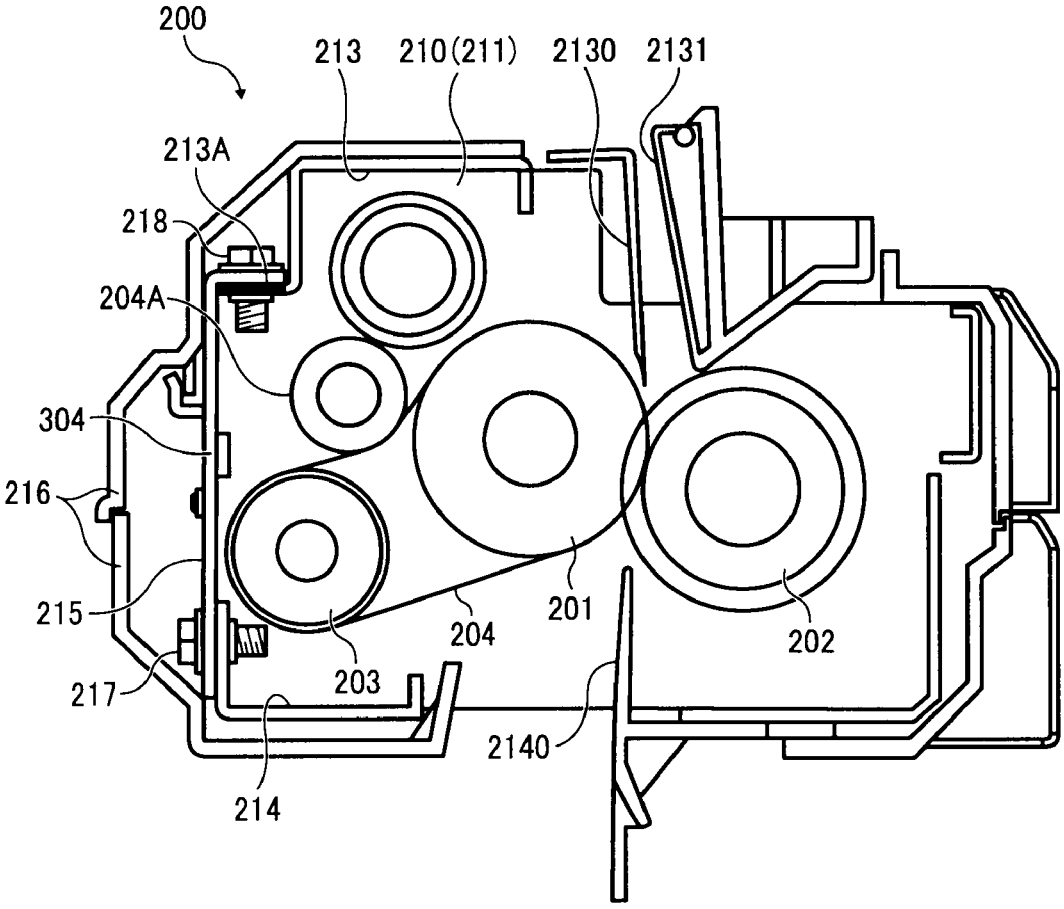
FIG. 2 is a schematic diagram of the fixing device shown in FIG. 1.

FIG. 2 is a schematic diagram for explaining a configuration of the fixing device 200. The fixing device 200 is a heat-roller fixing system that includes a fixing roller 201 and a pressing roller 202 that are opposed to each other across a conveyor path for conveying a recording sheet P.

The fixing roller 201 is arranged to face a toner image on the recording sheet P and heats the toner image. The pressing roller 202 is opposed to the fixing roller 201 and applies pressure to the recording sheet P. A heating roller 203 is arranged near the fixing roller 201 according to the embodiment, although not thus limited. A toner image is fixed to the recording sheet P by a fixing belt 204 that is stretched over the heating roller 203 and the fixing roller 201. A tension roller 204A applies tension to the fixing belt 204. The pressing roller 202 has a structure in which an elastic layer made of silicon rubber or the like is formed on a surface of a cored bar made of aluminum or iron and a release layer made of perfluoroalkylvinyl ether (PFA) or polytetrafluoroethylene (PTFE) is formed on a surface of the elastic layer.

Figure 3:
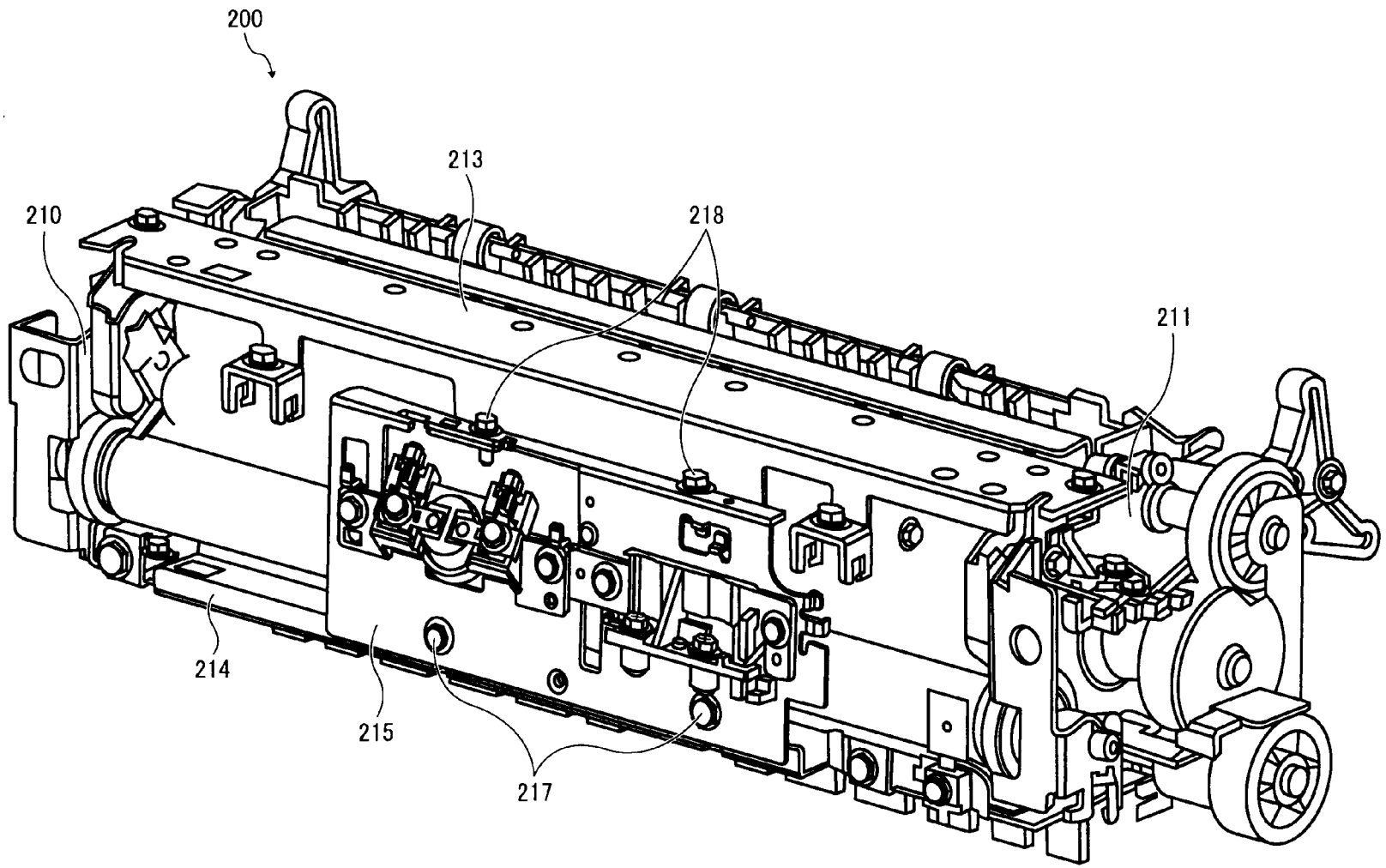
FIG. 3 is a perspective view of the fixing device shown in FIG. 2.

The fixing device 200 includes a casing that can house each of the rollers therein. As shown in FIGS. 2 and 3, the casing includes side plates 210, 211 as a pair of first frames that support an axis of each of the fixing roller 201 and the pressing roller 202 and an upper frame 213 and a lower frame 214 as a pair of second frames. The upper frame 213 and the lower frame 214 extend parallel to an axial direction of each of the fixing roller 201 and the pressing roller 202. The side plates 210, 211 can be connected to each other via the upper frame 213 and the lower frame 214.

The upper frame 213 includes a cover portion that can cover an upper peripheral surface of at least one of the fixing roller 201 and the pressing roller 202. The lower frame 214 includes a cover portion that can cover a lower peripheral surface of at least one of the fixing roller 201 and the pressing roller 202. A coupling member 215 is attached to the cover portions. Though later-described, much attention is paid to a function of sensing a state at a heating source in the embodiment. Therefore, the upper frame 213 and the lower frame 214 are arranged on a side on which the fixing roller 201 and the heating roller 203 are arranged, instead of a side on which the pressing roller 202 is arranged across the conveyor path. However, it is also possible to arrange the upper frame 213 and the lower frame 214 on the side of the pressing roller 202.

The upper frame 213 includes a releasing guide 2130 that releases the recording sheet P being adhered to the fixing roller 201 due to toner melted by fixing processing and a discharging guide 2131 that discharges the recording sheet P. The lower frame 214 includes a conveying guide 2140 that conveys the recording sheet P to a fixing position.

The coupling member 215 is separated from the upper frame 213 and the lower frame 214 and has a bridge structure to couple the cover portions to each other. Thus, the coupling member 215 can be added to the upper frame 213 and the lower frame, 214 independently.

The coupling member 215 formed as a sheet metal is connected to and integrated with the frames 213, 214 by using bolts 217, 218. When the coupling member 215 is connected to the upper frame 213 and the lower frame 214, a positional relation between the coupling member 215 and the frames 213, 214 can be adjusted based on a position at which the bolts 217, 218 are passed through. That is, the positional relation can be adjusted based on a coupling hole formed as a longer hole in a unilateral direction or in a crossing direction, or a hole diameter larger made larger than a bolt diameter.

The reason why the positional relation between the coupling member 215 and the frames 213, 214 is made adjustable is that when a sensing unit is arranged on the coupling member 215 to detect a physical parameter indicative of a fixing state, a positional relation between the sensing unit and a fixing member can be optimized.

The coupling member 215 has a bridge structure from the upper frame 213 to the lower frame 214. That is, the coupling member 215 is formed to fall down from a bending piece 213A that is formed on the upper frame 213 in parallel to the axial direction of the fixing roller 201 and the pressing roller 202. Therefore, the coupling member 215 functions as a reinforcing unit between the upper frame 213 and the lower frame 214 by arranging a convex portion such as a bead to increase section modulus in a hanging direction, that is, in an up-and-down direction, to be uneven. This makes it possible to prevent the upper frame 213 or the lower frame 214 from being twisted in a lateral direction with the casing due to a closed space unlike a case in which the upper frame 213 and the lower frame 214 are independent to each other.

Figure 4:
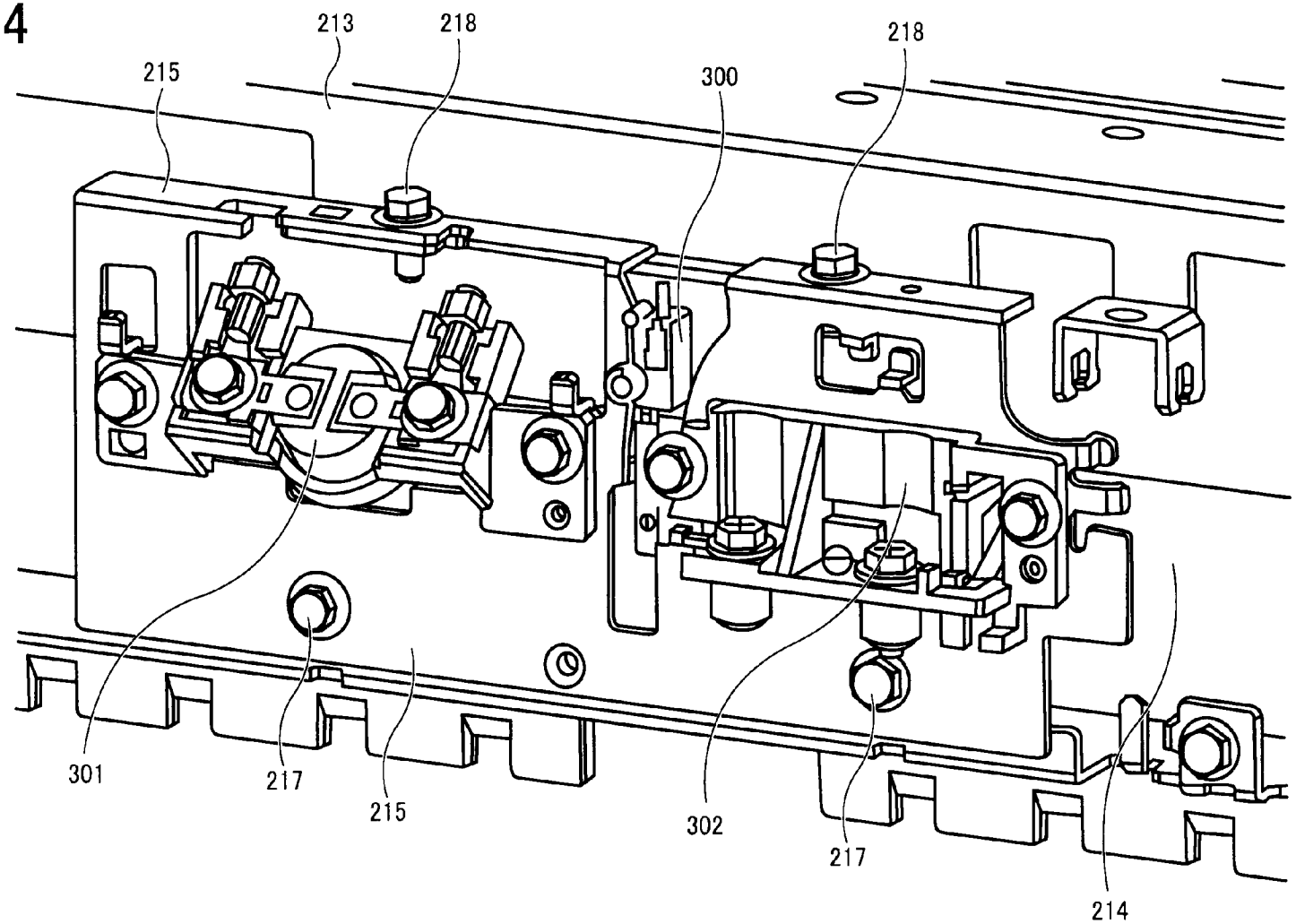
FIG. 4 is an enlarged view of a relevant part of the fixing device shown in FIG. 3.

The coupling member 215 is also used as a place to set a sensing unit that detects a physical parameter indicative of a fixing state. As shown in FIGS. 3 and 4, the coupling member 215 is positioned based on positional adjustment with respect to a member that is used for fixing, particularly the heating roller 203 (see FIG. 2) in which it is necessary to control temperature of a heat source. In the embodiment, the following sensing units are attached to the coupling member 215: a temperature sensor 300 that detects temperature of the fixing roller 201 or a heat source, an excessive temperature rise preventing safety device 301 that detects a physical parameter indicative of safety of a fixing state, and a replacement sensing device 302 that detects a physical parameter indicative of a replacement timing of the fixing device. Harnesses for housing wiring for the sensing units are wired from the coupling member 215 to a control unit (not shown).

As described above, when the fixing device 200 according to the embodiment is set up, the first frames and the second frames that constitute a housing are assembled and each of the rollers, the belt, and a driving source are housed therein.

Each of the sensing units is attached to the coupling member 215 having a bridge structure. Therefore, before the coupling member 215 is connected to the upper frame 213 and the lower frame 214, the sensing units are attached to the coupling member 215. At this time, the coupling member 215 can be adjusted in position, so that the sensing unit for detecting a fixing state and the member used for fixing, particularly the heating roller 203 and the sensing units, are properly positioned. Furthermore, the coupling member 215 can be used as a reinforcing unit with respect to the upper frame 213 and the lower frame 214 and its positional accuracy with the sensing unit is not decreased due to heat or an external force.

As described above, according to the embodiment, a positional relation between the sensing units and the fixing member can be properly maintained only by a simple configuration in which the coupling member 215 couples the upper and lower frames.

Next, a modified example of a relevant part of the embodiment is explained below.

As shown in FIG. 2, a surface of the coupling member 215 is covered by a housing 216 made of resin so that the sensing units are not to be exposed outside. Though a cover arranged not to expose the sensing units outside is well-known, the cover may be deformed due to heat from the fixing device, so that the sensing units may be interfered by the deformed cover. Thus, a positional relation between the sensing units and a sensed object becomes improper. False sensing is caused by the positional relation. When the cover is seriously deformed, the same result as that obtained when part of the housing of the fixing device is deformed is obtained, so that the fixing device may not be properly attached to or even detached from an image forming apparatus.

Figure 5:
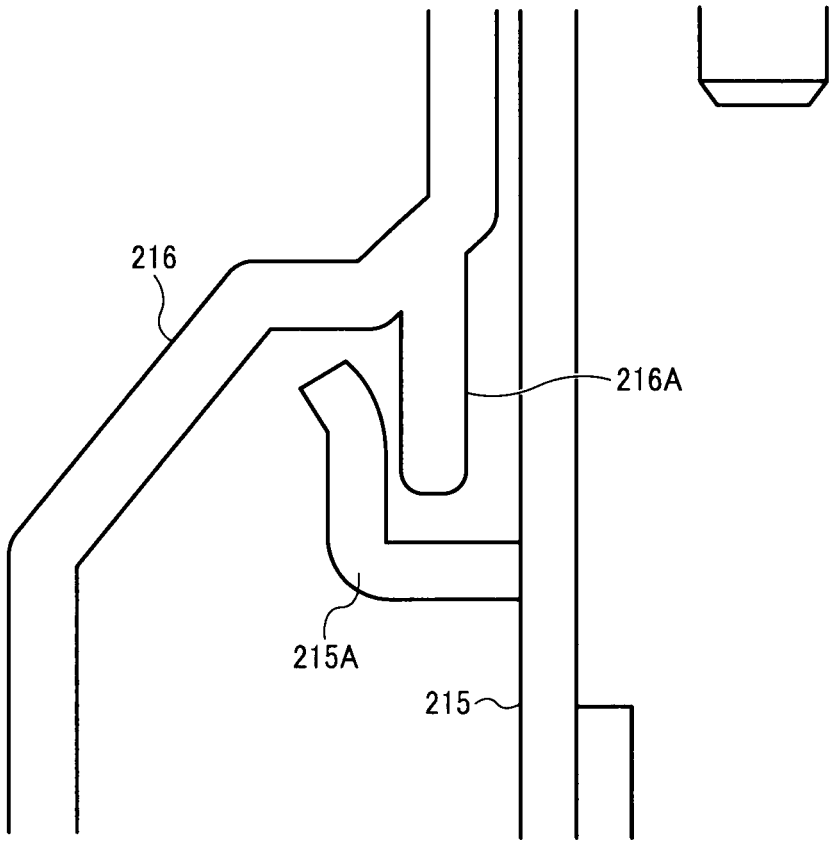
FIG. 5 is an enlarged view of a relevant part of the fixing device shown in FIG. 3 according to a modified example.

As shown in FIG. 5, the coupling member 215 that has high stiffness includes a hanging portion 215A like a hook which a locking portion 216A formed as part of the housing 216 can be inserted into or released from. Therefore, the housing 216 can be hung on the coupling member 215. This makes it possible to prevent the housing 216 from being thermally deformed. If the housing 216 should be deformed, the sensing units are not affected by the deformed housing, and still less is part of the housing deformed.

According to an aspect of the present invention, the coupling member having a bridge structure connects the frames and serves as a reinforcing unit with respect to each cover portions. Furthermore, the coupling member can be assembled independently, so that the sensing unit arranged on the coupling member can be assembled at an optimal position with good stability, compared to a case in which the sensing unit is directly housed in the casing. Consequently, it is unnecessary to enlarge a space to arrange a sensing unit in consideration of a difference in setting the sensing unit, thereby leading to prevention of an increase in size of a fixing device.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A fixing device comprising:

a fixing roller that applies heat to a recording medium on a conveyor path;

a pressing roller that is opposed to the fixing roller across the conveyor path and extends parallel to an axial direction of the fixing roller;

a casing that houses the fixing roller and the pressing roller in a rotatable manner;

a pair of first frames that support an axis of each of the fixing roller and the pressing roller;

a pair of second frames arranged in parallel to the axial direction such that the first frames are connected to each other via the second frames;

a first cover portion that is arranged on one of the second frames and covers an upper peripheral surface of at least one of the fixing roller and the pressing roller;

a second cover portion that is arranged on another one of the second frames and covers a lower peripheral surface of at least one of the fixing roller and the pressing roller; and a coupling member that couples the first cover portion to the second cover portion and has a bridge structure from the first cover portion to the second cover portion.

2. The fixing device according to claim 1, wherein a positional relation of the coupling member with respect to each of the first cover portion and the second cover portion is adjustable.

3. The fixing device according to claim 1, wherein the coupling member includes a reinforcing portion that reinforces the first cover portion and the second cover portion.

4. The fixing device according to claim 1, wherein the coupling member includes a sensing unit that detects a physical parameter indicative of a fixing state.

5. The fixing device according to claim 4, wherein the coupling member includes a harness for housing wiring for the sensing unit.

6. The fixing device according to claim 1, wherein the second frames include at least one of a conveying guide that conveys the recording medium and a discharging guide that discharges the recording medium, at a position where the recording medium is delivered.

7. The fixing device according to claim 1, further comprising a housing that covers an outer surface of the coupling member and is integrated with the coupling member.

8. The fixing device according to claim 4, wherein the sensing unit is one selected from the group of a temperature sensing member that detects a physical parameter indicative of temperature of the fixing roller, a safety sensing member that detects a physical parameter indicative of safety of a fixing state, and a replacement sensing member that detects a physical parameter indicative of a replacement timing of the fixing device.

9. An image forming apparatus comprising a fixing device including a fixing roller that applies heat to a recording medium on a conveyor path;

a pressing roller that is opposed to the fixing roller across the conveyor path and extends parallel to an axial direction of the fixing roller;

a casing that houses the fixing roller and the pressing roller in a rotatable manner;

a pair of first frames that support an axis of each of the fixing roller and the pressing roller;

a pair of second frames arranged in parallel to the axial direction such that the first frames are connected to each other via the second frames;

a first cover portion that is arranged on one of the second frames and covers an upper peripheral surface of at least one of the fixing roller and the pressing roller;

a second cover portion that is arranged on another one of the second frames and covers a lower peripheral surface of at least one of the fixing roller and the pressing roller; and a coupling member that couples the first cover portion to the second cover portion and has a bridge structure from the first cover portion to the second cover portion.

10. The image forming apparatus according to claim 9, wherein a positional relation of the coupling member with respect to each of the first cover portion and the second cover portion is adjustable.

11. The image forming apparatus according to claim 9, wherein the coupling member includes a reinforcing portion that reinforces the first cover portion and the second cover portion.

12. The image forming apparatus according to claim 9, wherein the coupling member includes a sensing unit that detects a physical parameter indicative of a fixing state.

13. The image forming apparatus according to claim 12, wherein the coupling member includes a harness for housing wiring for the sensing unit.

14. The image forming apparatus according to claim 9, wherein the second frames include at least one of a conveying guide that conveys the recording medium and a discharging guide that discharges the recording medium, at a position where the recording medium is delivered.

15. The image forming apparatus according to claim 9, further comprising a housing that covers an outer surface of the coupling member and is integrated with the coupling member.

16. The image forming apparatus according to claim 12, wherein the sensing unit is one selected from the group of a temperature sensing member that detects a physical parameter indicative of temperature of the fixing roller, a safety sensing member that detects a physical parameter indicative of safety of a fixing state, and a replacement sensing member that detects a physical parameter indicative of a replacement timing of the fixing device.

* * * * *